United States Patent [19]

Aanstad

[11] 3,934,419

[45] Jan. 27, 1976

[54] LOAD CONTROL SYSTEM ESPECIALLY ADAPTED FOR A HTGR POWER PLANT TURBINE

[75] Inventor: Ola J. Aanstad, Greensburg, Pa.

[73] Assignee: Westinghouse Electric Corporation, Pittsburgh, Pa.

[22] Filed: Aug. 15, 1974

[21] Appl. No.: 497,608

Related U.S. Application Data

[63] Continuation-in-part of Ser. No. 369,332, June 12, 1973, abandoned.

[52] U.S. Cl. ..... 60/660

[51] Int. Cl. ..... F01k 9/00

[58] Field of Search ..... 60/661, 662, 663, 664, 60/665, 666, 667; 415/17

[56] References Cited

UNITED STATES PATENTS

| | | | |
|---|---|---|---|
| 2,540,691 | 2/1951 | Reese et al. | 60/662 X |
| 2,586,510 | 2/1952 | Bryant | 60/662 X |
| 2,586,511 | 2/1952 | Bryant | 60/662 |
| 2,747,373 | 5/1956 | Eggenberger et al. | 60/663 X |
| 2,811,837 | 11/1957 | Eggenberger et al. | 60/663 X |
| 2,884,760 | 5/1959 | Buri | 60/662 X |
| 2,902,831 | 9/1959 | Ipsen et al. | 60/663 X |
| 3,055,181 | 9/1952 | Argersinger et al. | 60/662 X |
| 3,286,466 | 11/1966 | Stevens | 60/664 X |
| 3,511,051 | 5/1970 | Mitchell | 60/663 |
| 3,826,093 | 7/1974 | Miliaras | 60/662 X |

*Primary Examiner*—Martin P. Schwadron
*Assistant Examiner*—H. Burks, Sr.
*Attorney, Agent, or Firm*—E. F. Possessky

[57] ABSTRACT

The stages of a turbine system are independently controlled to produce a desired system power output by monitoring and comparing the power characteristics of each stage to the desired power output. Flow through each of the stages is adjusted until the desired power output is generated, while any flow that is passing through bypass lines about each of the turbine stages is varied inversely to the variations in the flow through the turbine stages. Non-linearities occurring in the system are offset by appropriate modification of the control of each stage and by comparison of the power output of the system with the power requirements to direct continuing control until the power requirements are met.

60 Claims, 5 Drawing Figures

LOAD CONTROL SYSTEM ESPECIALLY ADAPTED FOR A HTGR POWER PLANT TURBINE

CROSS REFERENCE TO RELATED APPLICATIONS

This is a continuation-in-part of Ser. No. 369,332, "Arrangement For Controlling The Loading of a Turbine System", filed June 12, 1973 and assigned to the same assignee, now abandoned.

BACKGROUND OF THE INVENTION

1. Field of the Invention

This invention relates generally to an arrangement for controlling the loading of a steam turbine system after synchronous speed has been reached, and more specifically, this invention relates to a loading control arrangement for a steam turbine system having steam bypass lines around each of the turbine stages, such as in a turbine system interfaced with a high temperature gas cooled reactor (HTGR), in which a drive turbine for the HTGR cooling system is included in the main turbine steam path.

2. Description of the Prior Art

In some types of steam turbine applications, it is desirable to keep the steam flow going through the system even when the turbines are not being driven to produce a power output. Thus, in this type of turbine system, it is necessary to provide bypass lines for the power turbine stages when power is not being extracted from the system. A so-called "European type" steam turbine bypass arrangement is utilized for starting some types of turbine systems.

Another, and very important, type of bypass arrangement is that utilized with a steam turbine system interfaced with a nuclear reactor, such as a high temperature gas cooled reactor (HTGR). In such a system, the steam generation, superheating and reheating of the steam is achieved in the HTGR, while a turbine for circulating coolant in the HTGR cooling system is driven by the steam flow through the turbine system. In order to provide a drive flow for the circulator turbine even when power is not being extracted from the system, a main steam bypass line is connected across the high pressure turbine stage, as well as a throttle valve and a control valve connected in the flow path of the high pressure turbine. Also, a hot reheat bypass line is connected across the intermediate pressure and low pressure turbine stages, as well as a reheat stop valve and an interceptor valve connected in the flow path of the intermediate and low pressure turbines.

When the turbine system has been brought to operating speed (in the case of a generating system this would be the speed necessary to drive an electrical generator to produce an electrical signal having a frequency in synchronism with the power line frequency, known as "synchronous speed"), the system is ready for loading. At this time, practically all of the steam flows through the bypass lines. Normally, a minimum flow of about 25% of the steam generated in the HTGR must be maintained to prevent steam generator instability and to drive the coolant circulator turbine. Therefore, prior to loading 25% of the HTGR generated steam is passing through the main steam bypass line, with the exception of approximately 3% to 4% passing through the main turbine to maintain synchronous speed. Also, this same amount of steam (approximately 25% of that generated) flows through the hot reheat bypass line, except for about 3% to 4% flowing directly to the intermediate and low pressure turbines through the hot reheat bypass line across the reheat stop valve and interceptor valve. This small flow through the intermediate pressure and low pressure turbines is for rotor cooling purposes in the low pressure turbine and turbine rotor heating in the intermediate pressure turbine.

In order to provide the desired power capabilities after synchronous speed has been achieved, it is desirable to transfer the steam flow through the bypass lines to the turbine stages as quickly as steam turbine thermal conditions and power system load demands permit. Loading is achieved by increasing the steam flow through the turbines while reducing steam flow through the bypass lines thereacross. To achieve this as quickly and efficiently as possible, it is necessary to simultaneously adjust the steam flow through the high pressure and intermediate and low pressure turbines, together with the bypass lines across these turbines.

One way of accomplishing this control is to mechanically gang the main steam control and interceptor valves so that these valves will be simultaneously opened or closed an equal or proportional amount. In addition, the valves in the main steam bypass and hot reheat bypass lines would also be ganged to close the valves in these lines to reduce the steam flow through the bypass lines by an amount equal to the increase in steam flow through the turbine stages. The problem with this approach is that if the valves utilized are not properly designed to perfectly match, the resulting non-linearity in the system may cause the power output generated by the system to vary considerably from that required. The design and manufacturing of the valves to minimize this error is extremely difficult. Further, even after the design problems have been overcome, there is always the chance that uneven wear or damage to the control system may introduce other non-linearities and corresponding undesired errors in the power generation.

SUMMARY OF THE INVENTION

In order to obviate the difficulties inherent in prior art arrangements, the present invention utilizes separate, but simultaneous, control of the first flow or main steam control and second flow or interceptor valves upon indication of the power required from the system. This indication of the power requirements is provided by an input signal, known in the trade as a megawatt demand signal. The input signal is provided by an input means, which may be activated directly by an operator or automatically, such as by an automatic dispatch system. A first detecting means, such as a pressure transducer, measures an applicable parameter, in this case the pressure, in the first or high pressure turbine stage and produces a signal indicative of the power output of that stage. Similarly, a second detecting means measures an applicable parameter (pressure) of a second turbine stage, such as the intermediate and low pressure turbines, and produces a signal indicative of the power output of that stage. The power signals derived from the first and second detecting means are then applied to first and second comparing means, respectively. Each of the comparing means also has the input signal applied thereto, and hence each of the comparing means determines the difference between the input signal and the power signal applied to that comparing means and produces an error signal representative thereof. A first error signal from the first comparing means and a second error signal from the second comparing means are then conveyed to first and second regulating means, respectively. The regulating means may be transfer circuits that transform the outputs of the comparing means into first and second control signals for adjusting a first flow valve (main steam control valve) and a second flow valve (interceptor valve), respectively.

Non-linearities in the system may be offset by utilizing correlating means to cause the adjustments made by the first and second regulating means to take into account these non-linearities, or by utilizing timing means to cause the first and second regulating means to continue adjustment of the first and second flow valves until the system generates the required power. For best performance, it is desirable to utilize both of these approaches to minimize the effects of non-linearities in the system. The correlating means may be in the form of first and second function generators that modify the input signal as applied to the first and second comparing means, respectively, to offset system non-linearities. The timing means may involve a comparison of the power actually generated with the power requirements to modify the input signal accordingly. Inasmuch as this modified input signal will then drive the turbine system to produce the desired power requirements, system non-linearities are offset. The timing means may include comparing means to compare the power generated and the input signal, an integrator circuit to produce a numeral designation in the vicinity of unity, and a multiplier circuit to modify the input signal by the numeral designation of the integrator.

In order to adjust first (main steam) and second (hot reheat) bypass valves upon adjustment of the main steam control and interceptor valves, respectively, appropriate first and second compensating means and provided for the main steam bypass valve and the hot reheat bypass valve, respectively. The first compensating means may include a third detecting means for determining a change in the conditions of the first turbine stage and comparing it with a reference to produce a third error signal that is applied to a third regulating means to produce a third control signal to adjust the main steam bypass valve. Similarly, the second compensating means may include a second detecting means for providing a fourth error signal to a fourth regulating means to produce a fourth control signal to adjust the hot reheat bypass valve. The first and second detecting means may include, respectively, third and fourth pressure transducers and third and fourth comparing means.

In order to speed the reaction of adjustment of the bypass valves and decouple the interaction effect between the flow valves and the bypass valves, the first and second control signals are applied to the first and second bypass valves, respectively. To achieve the feedforward control resulting from utilization of the first control signal on the first (main steam) bypass valve, the first control signal is passed through a first equalizing means which appropriately proportions the first control signal to be compatible with the third control signal, and is then connected to a fifth comparing means which determines the difference between this signal and the third control signal attained from the third regulating means. As a result, the first bypass valve is directly controlled concurrently with the first flow valve and is then trimmed or finally adjusted in accordance with the pressure upstream from the first flow valve and the first turbine stage. Similarly, a second equalizing means proportions the second control signal and applies it to a sixth comparing means with the fourth control signal obtained from the fourth regulating means.

From the foregoing discussion, it is clear that the present invention does away with the necessity of designing the various system valves to meet critical requirements. This is accomplished by appropriate controls to overcome any non-linearities that appear in the system. In addition, the control arrangement of this invention is such that modifications of this system as a result of wear or other influences during operation will be automatically compensated for, without disrupting the level of power generation such as might occur in prior art devices.

The foregoing and other objects, advantages and features of this invention will hereinafter appear, and for purposes of illustration, but not of limitation, exemplary embodiments of the subject invention are shown in the appended drawing.

DETAILED DESCRIPTION OF THE PREFERRED EMBODIMENTS

Figure 1:
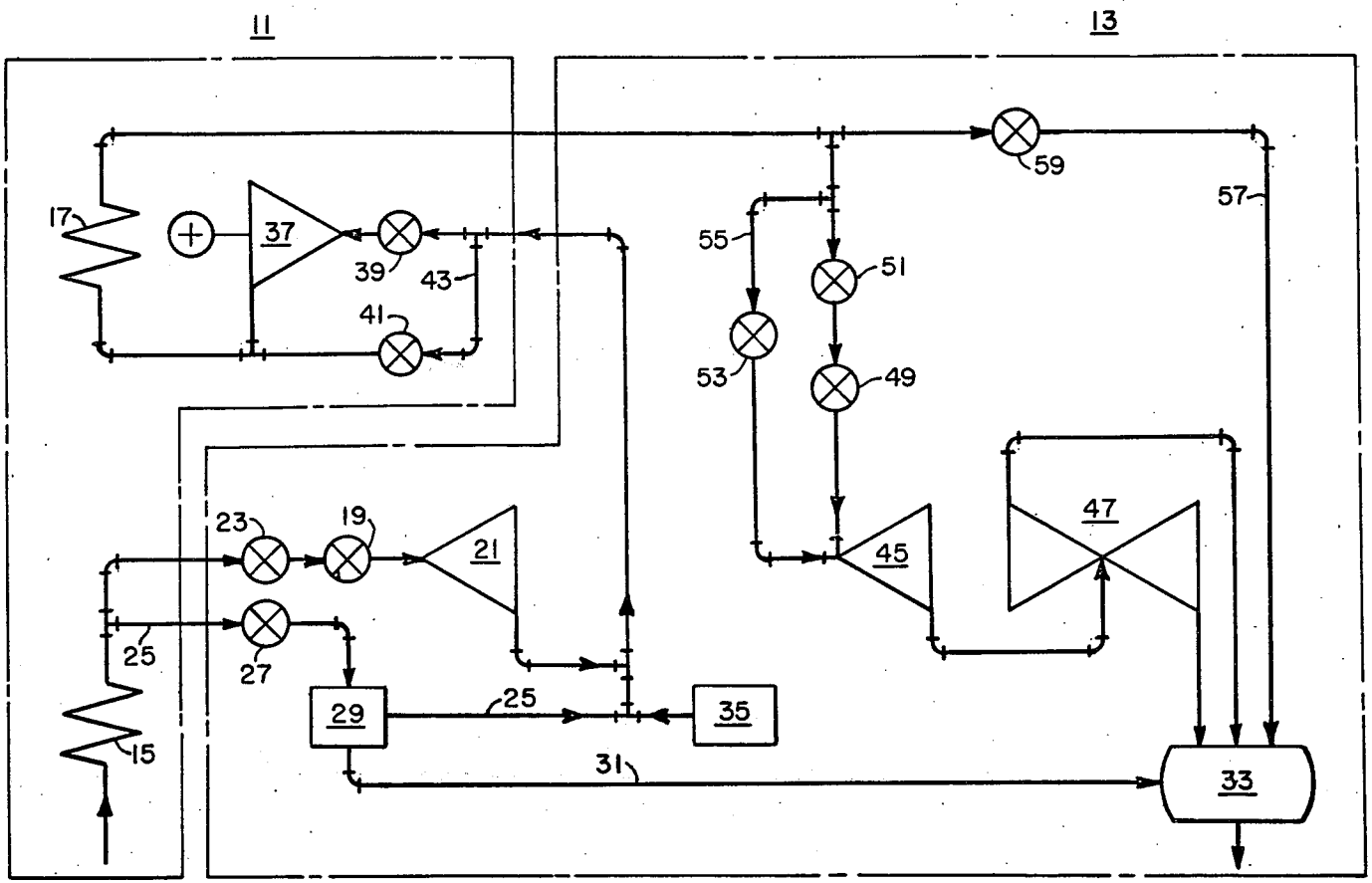
FIG. 1 is a schematic illustration of a turbine system in which the present invention may be utilized.

With reference to FIG. 1, a turbine system of the type with which the present invention is employed is illustrated. The following description will be of a turbine system such as that shown in FIG. 1, i.e., a steam turbine system interfaced with a nuclear reactor, specifically a high temperature gas cooled reactor (HTGR). Of course, this invention is equally applicable to any turbine system utilizing bypass lines around the turbine stages, such as the "European type" steam turbine bypass system utilized during start-up of some turbine systems.

The schematic illustration of FIG. 1 shows the elements included in the HTGR 11 that are relevant to the steam turbine 13 that is interfaced with HTGR 11. As turbine 13 utilized in this preferred embodiment is a steam turbine, HTGR 11 provides heat to boil water and superheat the steam in a steam generator 15. Also, HTGR 11 provides the energy for reheating the steam after it has been passed through first turbine stage. This reheating of the steam is accomplished in a reheater 17.

Steam from the steam generator 15 passes through a first flow valve 19 to a first turbine stage (high pressure turbine) 21. The first flow valve 19 is a main steam control valve utilized to determine the steam passing to the high pressure turbine 21. A throttle valve 23 is in the flow path of high pressure turbine 21, along with the control valve 19, and is primarily used to determine steam flow through the high pressure stage during initial startup.

A first or main steam bypass line 25 is connected across the high pressure turbine and its associated control throttle valves 19 and 23. Bypass line 25 provides a shunt or bypass flow path to permit maintenance of steam flow through the system, even when control valve 19 is closed to prevent any flow through the high pressure turbine 21. To maintain stable HTGR operation, this flow will normally be a minimum of about 25% of the rated steam flow generated in the HTGR.

Bypass line 25 includes a first or main steam bypass valve 27. Bypass valve 27 is utilized to control the flow through bypass line 25 and must be adjusted to insure that the steam flow through the high pressure turbine 21 is supplemented sufficiently to maintain the flow needed to keep the HTGR in operation. At the same time, it is desirable that the steam flow through line 25 be held to a mininum, so that productive steam flow through the power producing high pressure turbine 21 is maximized. Accordingly, it is necessary to interrelate control valve 19 and bypass valve 27 to insure that no more steam flow occurs through bypass line 25 than is necessary to keep the total steam flow above the minimum level necessary to maintain stable HTGR operation.

A flash tank 29 is included in bypass line 25. In addition to passing steam to the rest of the system, flash tank 29 conveys steam through a line 31 to a condenser 33.

Additional steam may be introduced into the system from an auxiliary boiler 35, when necessary. However, as auxiliary boiler 35 would introduce no steam during the portion of the operation that relates to the present invention, no further description of this aspect is necessary or included herein.

From the output of high pressure turbine 21 (and/or bypass line 25), the steam passes to a turbine 37. Turbine 37 is utilized to drive or circulate a coolant, such as helium, to remove the heat generated in the HTGR core. It is to maintain operation of this helium circulator turbine 37 during main turbine start up and shut down and to provide a flow path for the initial reactor flow that bypass lines around the turbine stages of this turbine system are required.

A helium circulator control valve 39 is in the flow path of turbine 37 to adjust the flow through turbine 37. In addition, a helium circulator bypass valve 41 is located in a helium circulator bypass line 43. Valves 39 and 41 are utilized to adjust the flow through helium circulator turbine 37 to maintain proper operating conditions for this turbine. For the helium circulator turbine 37, the steam flow is through reheater 17 to a second turbine stage that may consist of an intermediate pressure turbine 45 and a low pressure turbine 47. Intermediate pressure turbine 45 is shown as a single flow turbine, while low pressure turbine 47 is shown as a double flow turbine. These are, of course, merely illustrative of a common approach utilized in the turbine field and may be modified to fulfill the requirements of any particular application.

Steam flow through the intermediate and low pressure turbines 45 and 47 is basically determined by a second flow, or interceptor, valve 49. A reheat stop valve 51 is, along with interceptor valve 49, in the flow path of the second turbine stage and provides an on-off control of the steam flow through the intermediate and low pressure turbines 45 and 47. In addition, a bypass valve 53 is located in a bypass line 55 that provides a bypass around interceptor valve 49 and reheat stop valve 51. The bypass line 55 is utilized to provide a small steam flow to the intermediate and low pressure turbines 45 and 47 for cooling purposes prior to loading of this stage. Both reheat stop valve 51 and bypass valve 53 are simple open-close valves with no position modulation. Reheat stop valve 51 is opened wide upon initiation of loading of the system, while bypass valve 53 is closed at that time.

A second or hot reheat bypass line 57 is connected across the intermediate and low pressure turbines, along with the interceptor and reheat stop valves 49 and 51. A second or hot reheat bypass valve 59 is located in hot reheat bypass line 57 to control the steam flow through bypass line 57. The purpose of hot reheat bypass valve 59 is similar to that of main steam bypass valve 27, and hence valve 59 must be interrelated with interceptor valve 49 to determine the flow through line 57 to produce a flow effect the inverse of that produced on the flow through the second turbine stage by valve 49.

The steam from the hot reheat bypass line 57 and from the low pressure turbine 47 is conveyed to condenser 33. The cooled steam in condenser 33 is condensed and returned to the steam generator 15 for recycling.

As the present invention relates to the initial loading of the turbine stages after synchronous speed has been reached, it is desirable to understand the operation of the turbine system of FIG. 1 after the system has been brought up to synchronous speed. As indicated previously, a flow of approximately 25% HTGR generated steam is passing through the turbine system to maintain operation of the HTGR. Most of the steam flow is, of course, through the bypass lines 25 adnd 27. However, there is some steam flow through the high pressure turbine 21 (approximately 3%–4%) in order to maintain the synchronous speed of the system. At the second stage, an equally small proportion (approximately 3%–4%) is passing through the interceptor valve bypass line 55 to the intermediate and low pressure turbines 45 to 47 for rotor cooling purposes. Inasmuch as bypass line 55 carries such a very small flow, as soon as loading of the intermediate and low pressure turbines is begun, the bypass valve 53 is closed and this line is essentially out of the system. Accordingly, the existence of this line may be ignored after initial loading is initiated.

The purpose of the present invention is to load the high pressure and intermediate and low pressure turbines as quickly as thermal conditions and power system load demand permit. In addition, it is desired to load the high pressure and intermediate and low turbine equally and in unison. The initial loading is achieved by transferring the steam flow through the bypass lines to the turbine stages before increasing the steam flow from the HTGR. The preferred embodiment of the present invention utilized in achieving these results may be seen in FIG. 2. Elements identified in FIG. 1 are identified by primed numerals, corresponding to the numerals of FIG. 1, in this FIG. 2.

In order to better comprehend the present invention, is should be understood that the control valve 19, the interceptor valve 49, the main steam bypass valve 27 and the hot reheat bypass valve 59 are electrically controlled valves. Each of these valves is hydraulically opened and includes a positive spring bias toward the closed position. Thus, in the event of an electrical failure, the valves would be closed and the system shut down.

The control arrangement of this invention is actuated in response to an input signal that indicates the power requirements that must be supplied by the turbine system. In the trade, this signal is frequently referred to as a "megawatt demand" signal. The input signal is provided by an input means 61. Input means 61 may be any appropriate device for indicating power requirements, such as a power indicator that may be manually set by an operator or by a remote signal from an automatic dispatch system.

The input signal for input means 61 is conveyed to a first comparing means 63 and a second comparing means 65. Comparing means 63 and 65 may be any appropriate type of circuits that can compare two inputs and produce an output or error signal indicative of the difference between the two input signals. An example of such a circuit would be a sum or difference circuit employing an operational amplifier. Of course, although an analog approach is utilized in this preferred embodiment, a digital system could be utilized in which comparing means 63 and 65 would be an appropriate difference indicator, such as an up-down counter. Also, in appropriate computer program or "software" could be utilized to provide an appropriate control.

Another input signal to comparing means 63 is provided by a detecting means 67. Detecting means 67 is schematically illustrated by the dotted line extending from high pressure turbine 21' to comparing means 63. The purpose of detecting means 67 is to measure a parameter of the high pressure turbine 21' and convert the measurement into a power signal representing the power output of turbine 21'. In this is preferred embodiment, detecting means 67 is a conventional pressure transducer that converts the pressure in high pressure turbine 21' to a power signal indicative of the power output of the turbine system. As may be seen by the indicated signs, the power signal from detecting means 67 is subtracted from the input signal. Hence, the error signal produced by comparing means 63 is actually an indication of the additional power that must be produced by the turbine system to meet the power requirements indicated by the input signal.

A second detecting means or pressure transducer 69 is schematically illustrated by a dotted line from intermediate pressure turbine 45' to comparing means 65. Detecting means 69 is also a conventional pressure transducer and operates in the same fashion as detecting means 67 to produce a second power signal. Hence, the error signal output of comparing means 65 also indicates the difference between the power requirements and the actual power output of the turbine system (although the system power output indicated by detecting means 69 may differ from that indicated by detecting means 67). To the extent that non-linearities exist in the system and in the detecting means 67 and 69, however, the outputs of comparing means 63 and 65 may differ.

The error signal from comparing means 63 is fed to a regulating means 71 that transforms the error signal into a control signal to adjust the positioning of main steam control valve 19'. Regulating means 71 may be a transfer circuit of the type known as a proportional plus integral (PI) circuit. In such a proportional plus integral circuit the control valve 19' is positioned in accordance with a signal that is the sum of a first component that is proportional to the output signal from comparing means 63 and a second component that is proportional to the time integral of the output signal from comparing means 63. The integrator portion of regulating means 71 has a time constant sufficiently long (e.g., three or four seconds) to permit the power signal produced by detection means 67 to modify the error signal produced by comparing means 53 prior to complete adjustment of control valve 19'. In other words, as the control signal from transfer circuit 71 begins to adjust control valve 19', the pressure in high pressure turbine 21' will change and the power signal produced by pressure transducer 67 will reflect this change. As a result of the time delay in the transfer circuit 71, the adjustment of control valve 19' will be gradual. Such a continuous and gradual adjustment of control valve 19' is necessary to prevent the production of shock waves and other system problems that could result from discontinuity in the adjustment of the steam flow through the high pressure turbine.

A second regulating means 73, similar to regulating means 71, has the error signal from comparing means 65 applied to it. Regulating means 73 may be a proportional plus integral (PI) transfer circuit that produces a second control signal for adjusting the interceptor valve 49'. The proportional adjustment and the time constant of the integrator of the transfer circuit 73 may differ from those of transfer circuit 71 in order to reflect differences between control valve 19' and interceptor valve 49'.

With the system described thus far, a workable control arrangement is produced. With the turbine system at synchronous speed, a power demand would produce an input signal that would result in the control valve 19' and the interceptor valve 49' being adjusted to produce a power output that would appear as the required power to both the high pressure turbine 21' and the intermediate pressure turbine 45'. Of course, it would be necessary to provide adjusting means to inversely control the main steam bypass valve 29' and the hot reheat bypass valve 59'. This could be accomplished by a simple mechanical ganging arrangement, but a preferred embodiment of this control is described below.

Although the system described to this point would obviate errors resulting from non-linearities in the valves and some other portions of the system, the high pressure turbines 21', the intermediate pressure turbine 45', the detecting means 67 and 69, the comparing means 63 and 65, the regulating means 71 and 73, and the control valve 19' and the interceptor valve 49' would have to be carefully designed to have the first and second turbine stages respond identically, so that the system would generate the actual power required. Such careful designing would still be considerably simpler than the design and construction of mechanically ganged controls, but the present invention contemplates still further reduction of these tasks. If there were non-linearities present during initial loading, the flow through the high pressure turbine and the flow through the intermediate and low pressure turbines might not be identical, with the result that the power actually generated might differ somewhat from that required, but the system would reach a stable operating point.

To preclude the necessity of accurate design of certain of the system and control elements, correlating means have been included to cause the regulating means 71 and 73 to adjust control valve 19' and interceptor valve 49' to produce the same flow variations. In this preferred embodiment, the correlating means take the form of a pair of function generators 75 and 77. These function generators 75 and 77 may be any appropriate type of circuitry that will modify the input signal as required. Function generators 75 and 77 are used to modify the input signal to produce equivalent variations in the flow through the first and second turbine stages. As the requisite modification of the input signal may be empirically determined, the function generators may be set to accurately compensate for any non-linearities in the system with a minimum of effort.

Figure 2:
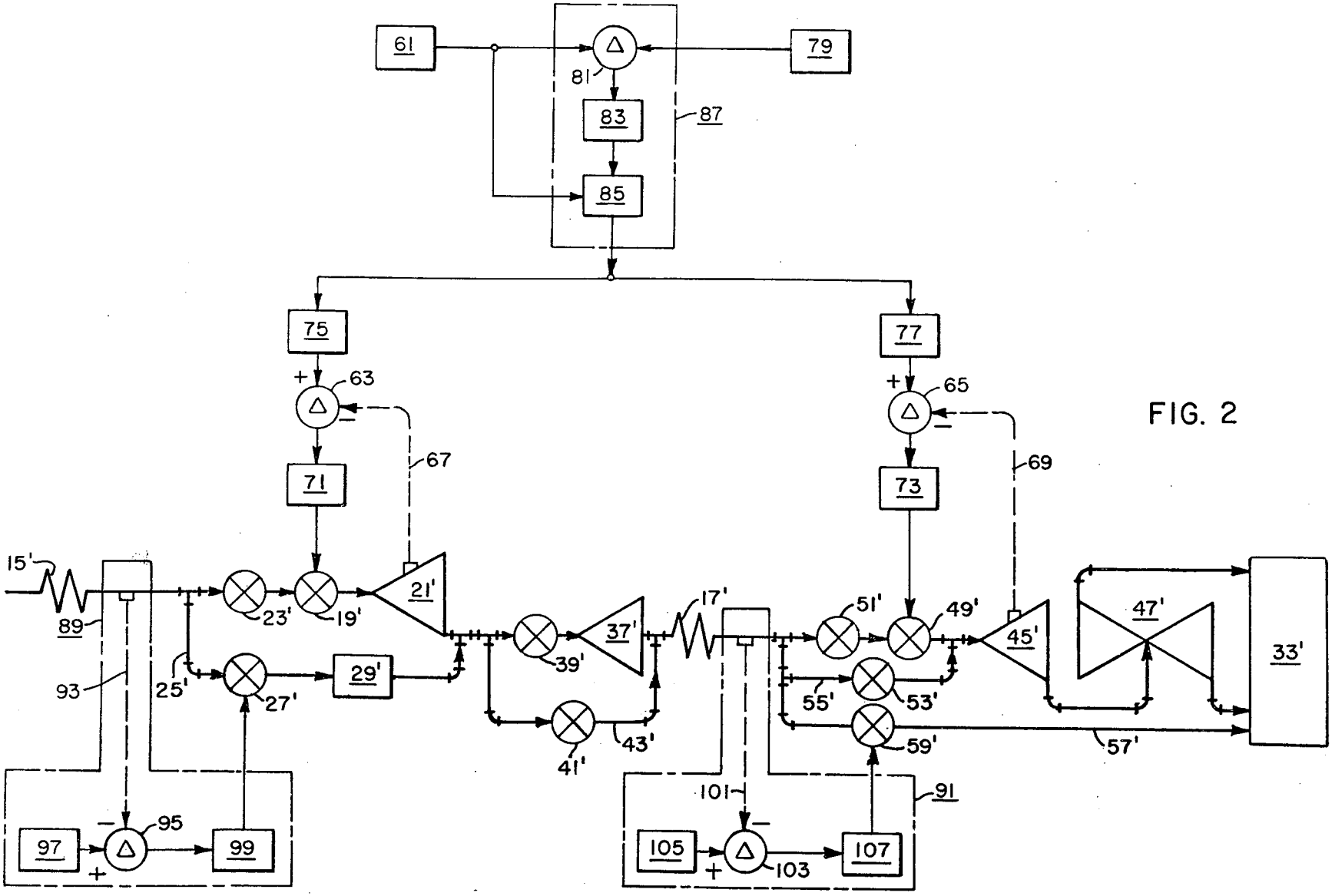
FIG. 2 is a schematic illustration of a first embodiment of the present invention as utilized in the turbine system depicted in FIG. 1.

Another approach to eliminate the effect of non-linearities on the output of the system, although it does not correct for internal inconsistencies, is to modify the input signal until the power output of the system equals the power requirements. A generator 79 driven by the turbine system is schematically shown in FIG. 2. The output of generator 79 is applied to a comparing means 81. Also applied to comparing means 81 is the input signal from the input means 61. Comparing means 81 is similar to the comparing means 63 and 65.

The output of comparing means 81, which is the difference between the input signal and the signal representing the power output of the turbine system, is conveyed to an integrator circuit 83. Integrator circuit 83 has a long time constant compared to the time constants of the regulating means 71 and 73 (e.g., 20 seconds). As a result of this long time constant, the signal from comparing means 81 does not produce any appreciable result until the system has had an opportunity to complete its reaction to the initial application of the input signal.

From integrator circuit 83, an output signal is applied to a multiplier 85. The input signal is also applied to multiplier 85. As the integrator circuit 83 will produce the equivalent of a numerical "one" in the absence of a signal from comparing means 81, the output of multiplier 85 will be the input signal, unless an output is obtained from comparing means 81. If comparing means 81 produces an output, the input signal as applied to function generators 75 and 77, is modified to represent a power requirement higher or lower than that actually required. Thus, the turbine system will be controlled to produce the actual power requirements, although the input signal applied to function generators 75 and 77 would appear to represent a higher or lower power requirement.

Combination of comparing means 81, integrator circuit 83, and multiplier 85 provides a timing means 87 that produces the control adjustment discussed immediately above. While this timing means, or the correlating means including function generators 75 and 77, may be utilized individually, the preferred embodiment of this invention incorporates both the timing means 87 and the function generators 75 and 77, as shown.

As previously indicated, it is necessary to adjust the bypass valves 27' and 59' in accordance with, and inversely to, the adjustment of the control valve 19' and the interceptor valve 49', respectively. Preferred forms of a first compensating means 89 and a second compensating means 91 are illustrated in FIG. 2. A third pressure transducer 93 and a third comparing means 95 form a third detecting means that measures a parameter of the high pressure turbine stage, compares it with a reference for that parameter and and produces a third error signal indicative of the difference between the reference and the measured signal. In this case, of course, the parameter measured is the pressure upstream from the high pressure turbine 21' and the control valve 19' (which is the pressure at the input to the throttle valve 29'). A reference signal indicating a reference level for the pressure at the point in the line where the pressure is measured by the pressure transducer 93 is provided by a reference source 97. The third error signal produced by the comparing means 95 is then applied to a third regulating means 99. Regulating means 99 is a third proportional plus integral (PI) transfer circuit similar to the regulating means 71 and 73.

With this arrangement, a change in the pressure at the input to throttle valve 23', resulting from an adjustment of control valve 19', causes comparing means 95 to produce a third error signal, which in turn activates regulating means 99 to produce a third control signal to adjust main steam bypass valve 27'. The adjustment of main steam bypass valve 27' is such as to produce an effect on the flow through the bypass line 25' that is the inverse of the flow variation through the high pressure turbine 21'. In other words, if control valve 19' is opened to increase the flow through the high pressure turbine 21', main steam bypass valve 27' will be closed to reduce the flow through the main steam bypass line 25' and hence maintain the pressure at the input to throttle valve 23' at the reference level.

The compensating means 91 is similar to compensating means 89 and includes a fourth pressure transducer 101 and a fourth comparing means 103 that form a fourth detecting means to measure the pressure upstream from the intermediate pressure turbine and the interceptor valve 49', compare the signal representing that pressure to a reference level for the pressure at that point in the line, and produce a fourth error signal. A second reference source 105 produces the reference signal applied to comparing means 103. The fourth error signal from comparing means 103 is applied to a fourth regulating means 107, such as a proportional plus integral (PI) transfer circuit, which produces a fourth control signal to adjust hot reheat bypass valve 59'. Compensating means 91 operates in the same fashion as compensating means 89 to vary the steam flow through hot reheat bypass line 57' inversely to the variation of the steam flow through the intermediate pressure turbine 45' produced by adjustment of interceptor valve 49'.

Although the operation of the compensating means 89 and 91 are quite acceptable, they do not provide any method for decoupling the interaction between control valve 19' and the main steam bypass valve 27', or the interaction between interceptor valve 49' and hot reheat bypass valve 59'. Due to the fact that the bypass valves 27' and 59' are adjusted in response to a pressure change produced by adjustment of the flow valves 19' and 49', this interaction results in a time delay in adjusting the bypass valves. Accordingly, a further improvement and modification of the arrangement of FIG. 2 is shown in FIG. 3.

Figure 3:
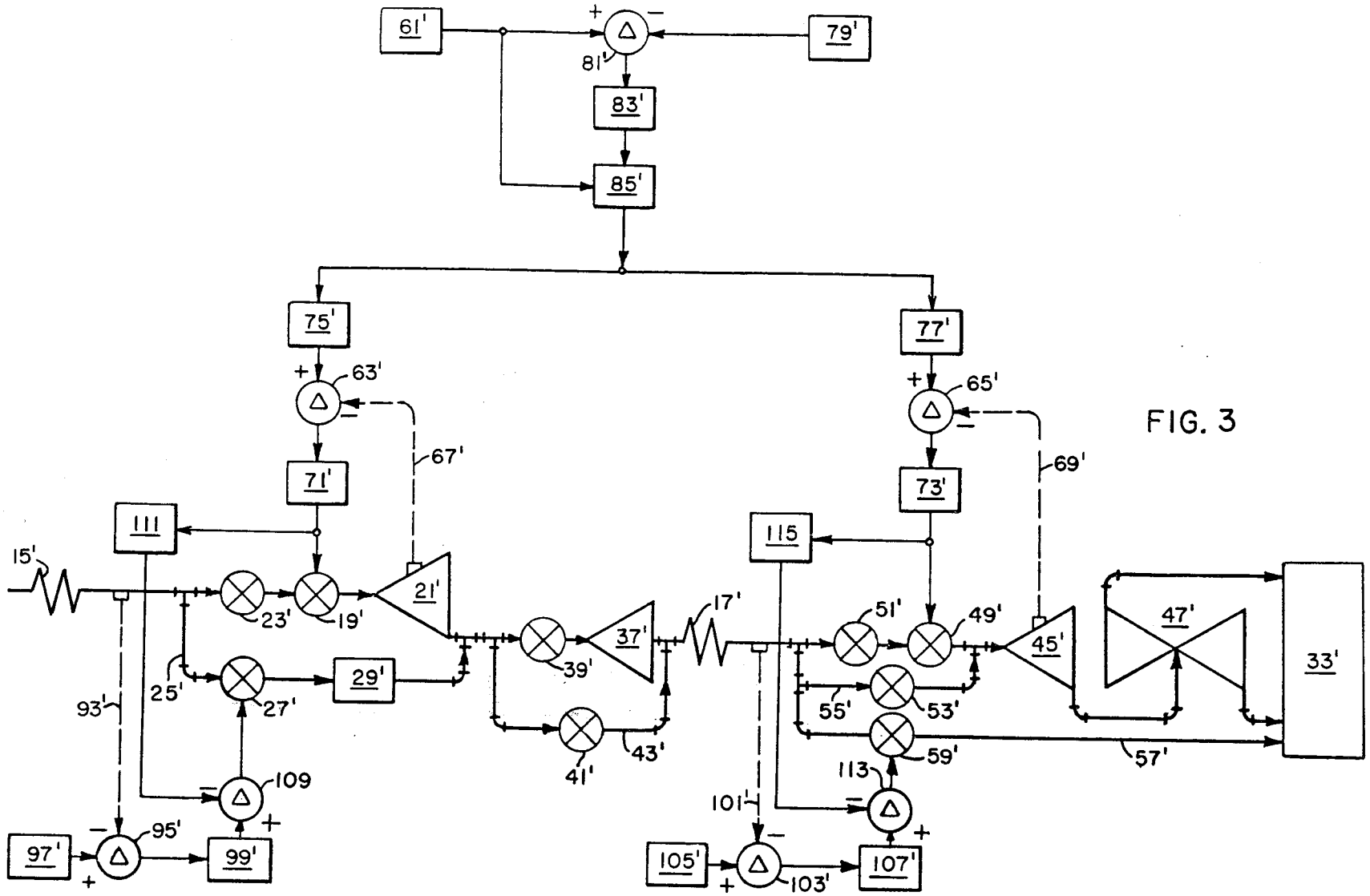
FIG. 3 is a schematic illustration of a second embodiment of the present invention, which involves a modification of the embodiment depicted in FIG. 2.

In the arrangement of FIG. 3, there is a feed forward action of the control signals from regulating means 71 and 73 to the related bypass valves 27' and 59', respectively. This is accomplished by including a fifth comparing means 109 that receives the first control signal from regulating means 71 and the third control signal from the third regulating means 99. An equalizing means 111 is utilized to make the first control signal from regulating means 71 comparable to the third control signal from regulating means 99. Equalizing means 111 may be a simple proportioning circuit that places the first control signal on the same scale as the third control signal. As a result of this arrangement, the main steam bypass valve 27' will be adjusted directly upon adjustment of the main steam control valve 19' (albeit inversely thereto), in direct response to the input signal. The final setting of the main steam bypass valve 27' is then adjusted by the third control signal, as modified by the effect of the first control signal and comparing means 109. In this fashion, the main steam bypass valve 27' is adjusted more quickly and in direct inverse proportion to the adjustment of the control valve 19', while still being ultimately adjusted to maintain the desired pressure level upstream from the high pressure turbine 21'.

Similarly, a sixth comparing means 113 and a second equalizing means 115 are utilized in controlling the adjustment of reheat bypass valve 59'. In this case, the adjustment of the hot reheat bypass valve 59' is controlled in direct inverse proportion to the adjustment of interceptor valve 49', while still being ultimately adjusted to maintain the desired pressure upstream from the intermediate and low pressure turbines 45' and 47'.

POWER SPLIT AND TURBINE FLOW EQUALIZATION OF EMBODIMENT OF FIGURE 2

More specifically, in the preferred more detailed operation of the embodiment of FIG. 2 it is assumed that the desired minimum steam flow through the steam generator 15' and the reheater 17' is sufficient to generate a power output equal to 25% of maximum plant power output when the desired minimum flow passes through the first turbine stage 21' and the second turbine stage comprising the intermediate and low pressure turbines 45' and 47'. It is understood that the desired minimum steam flow depends on the design of the steam generator 15' and the reheater 17' and that the operation of the present invention is not limited to a desired minimum steam flow of the value above stated.

A small steam flow passes through the turbines 21', 45' and 47' to maintain synchronous speed after synchronization and prior to initial loading. Prior to initial loading, the compensating means 89 positions the valve 27' so that the sum of the steam flow through the turbine 21' to maintain synchronous speed, with the flow through the bypass line 25', is equal to the desired minimum flow through the steam generator 15'. Similarly the compensating means 91 positions the bypass valve 59' so that the sum of the steam flow through the turbines 45' and 47' to maintain synchronous speed, with the steam flow through the bypass line 57', is equal to the desired minimum flow through the reheater 17'. The reference source 97 generates a desired value of the steam pressure at the outlet the steam generator 15' that is in accordance with the desired minimum flow through the steam generator 15'. The reference source 105 generates a desired value of the steam pressure at the outlet of the reheater 17' that is in accordance with the desired minimum flow through the reheater 17'. The desired minimum steam flows through the steam generator 15' and the reheater 17' are effectively equal.

To effect loading, the megawatt demand signal from the input means 61 is increased in accordance with thermal conditions and power system load requirements. In response to the signal that is generated by the multiplier 85, the correlating means 75 and 77 generate power demand signals that are transmitted respectively to the comparators 63 and 65. The regulating means 71 and 73 respectively position the valves 19' and 49' to cause steam flows through the turbines 21' and 45' such that the output signal of the comparators 63 and 65 are reduced to zero. When the output signals of the comparators are reduced to zero, the power output signal of the detecting means 67 is equal to the power demand signal generated by the correlating means 75, and the power output signal of the detecting means 69 is equal to the power demand signal generated by the correlating means 77. Although the steam flows through the turbines 21' and 45' are equal when the bypass valves 27' and 59' are closed, such flows are not necessarily equal when the valves 27' and 59' are open. Preferably the correlating means 75 and 77 generate their respective power demand signals so that the steam flows through the turbines 21' and 45' are equal when the output signals of the comparators 63 and 65 are reduced to zero. In other words, the correlating means 75 and 77 generate output signals to cause the regulating means 71 and 73 to adjust the valves 19' and 49' to produce equal flows through the turbines 21' and 45'. The power demand signals generated by the correlating means 75 and 77 split the signal that is generated by the multiplier 85, i.e. the sum of the power demand signal generated by the correlating means 75 with the power demand signal generated by the correlating means 77 is equal to the signal generated by the multiplier 85. When the regulating means 71 and 73 vary the turbine steam flows to reduce to zero the output signals of the comparators 63 and 68, the total power detected by the detecting means 67 and 69 is equal to the required power that is represented by the output signal of the multiplier 85.

The detected power output of the generator 79 is compared by the comparator 81 with the desired power output represented by the megawatt demand signal. When the desired power output and the detected power output of the generator 79 are not equal, the output signal of the comparator 81 represents a power error that is integrated by the integrator 83. The multiplier 85 multiplies the megawatt demand signal by the output signal of the integrator 83 to produce a required power signal that represents the desired power output modified in accordance with the integrated power error. The correlating means 75 and 77 vary their power demand signals in response to the required power signal from the multiplier 85, and the power error is reduced when the regulating means 71 and 73 vary the turbine steam flows to reduce the output signals of the comparators 63 and 65. The output signals of the integrator 83 and of the multiplier 85 continue to change until the power error signal is reduced to a steady state value of zero, as a result of adjustment of the turbine steam flows by the regulating means 71 and 73 in accordance with the output signals of the comparators 63 and 65.

Although the megwatt demand signal may be transmitted directly from the input means 61 to the correlating means 75 and 77, transmission of the megawatt demand signal through the timing means 87 to the correlating means 75 and 77 desirably monitors the value of the detected power output of the generator 79 against the value of the desired power output, and differences that develop between such values are reduced to zero.

When the megwatt demand requires turbine steam flows that are less than the desired minimum flow, the compensating means 89 and 91 control the steam flows through the bypass lines 25' and 57' to reduce to zero the output signals of the comparators 95 and 103. When the comparator output signals are reduced to zero, the pressure value detected by the pressure transducer 93 is equal to the desired pressure value represented by the output signal of the reference source 97, and the pressure value detected by the pressure transducer 101 is equal to the desired pressure value represented by the output signal of the reference source 105. Because the desired pressure values represented by the output signals of the reference sources 97 and 105 are in accordance with the desired minimum flow through the steam generator 15' and the reheater 17' respectively, the compensating means 89 and 91 thus adjust the steam flows through the bypass lines 25' and 57' to maintain the desired minimum flow through the steam generator and the reheater.

After synchronization and prior to initial loading a small portion of the desired minimum flow through the steam generator 15' passes through the turbine 21' to maintain synchronous speed while the compensating means 89 positions the value 27' to cause the remainder of the desired minimum flow to pass through the bypass line 25'. Similarly a small portion of the desired minimum flow through the reheater 17' passes through the turbines 45' and 47' for purposes of maintaining synchronous speed, while the compensating means 91 positions the valve 59' to cause the remainder of the desired minimum flow to pass through the bypass line 57'. As the megawatt demand signal is increased, the steam flows through the turbines 21' and 45' are increased to cause the generator 79 to generate the power output that is desired. The turbine steam flows are increased equally, as heretofore discussed with respect to the function of correlating means 75 and 77. As the turbine steam flows are increased, the compensating means 89 and 81 decrease the steam flows through the bypass lines 25' and 57' to maintain the desired steam flow through the steam generator 15' and the reheater 17'. The compensating means 89 and 91 may be said to govern the steam flows through the bypass lines 25' and 57' inversely to the steam flows through the corresponding turbines.

When the megawatt demand requires turbine steam flows that are equal to the desired minimum steam flow through the steam generator 15' and the reheater 17' (as above stated, a megawatt demand equal to 25% of maximum plant power output) the compensating means 89 and 91 accordingly close the valves 27' and 59', as no flow through the bypass lines is required to maintain the desired minimum flow through the steam generator 15' and the reheater 17'. Preferably the valve 49' permits the desired minimum flow to pass through the turbines 45' and 47' when the valve 49' is fully opened and the pressure detected by the transducer 101 is equal to the desired pressure represented by the output signal of the reference source 105. If the valve 49' permits a flow greater than the desired minimum flow when the valve 49' is fully opened and the pressure transducer 101 detects the reference pressure generated by the reference source 105, then both the valve 19' and the valve 49' must be positioned to govern the power output of the generator 79 at megawatt demands that exceed 25% maximum plant power output. By sizing the valve 49' in the preferred manner, it is necessary only to position the valve 19' to control the power output when the megawatt demand exceeds 25% maximum plant power output.

Over the megawatt demand range 25% to 100%, the correlating means 77 generates a power demand signal that exceeds the greatest output signal generated by the detecting means 69 over such range, causing the regulating means 73 to hold the valve 49' fully open. Over such megawatt demand range the reference source 105 generates a pressure reference signal that exceeds the greatest pressure signal that is generated by the pressure detecting means 101, to cause the regulating means 107 to hold the bypass valve 59' closed. Similarly, the reference source 97 generates a pressure reference signal that exceeds the greatest pressure signal that is generated by the pressure detecting means 93 over the megawatt demand range 25% to 100%, to cause the regulating means 99 to hold the bypass valve 27'closed. Between megawatt demands of 25% and 100%, the correlating means 75 transmits the output signal of the multiplier 85 to the input of the comparison device 63, while the signal generated by the detecting means 67 represents the power output of the entire turbine system, as hereinafter discussed. Therefore the regulating means 71 positions the valve 19' to cause a steam flow through the turbine system such that the power output of the turbine system as detected by the detecting means 67 is effectively equal to the required power that is represented by the output signal of the multiplier 85.

As previously discussed, the timing means 87 compares the detected power output of the generator 79 with the desired power output represented by the megawatt demand signal. Between megawatt demands of 25% and 100%, the output signal of the multiplier 85 is varied to cause the regulating means 71 to vary the steam flow through the turbine system in accordance with the output signal of the comparison device 63 to reduce a power error between the desired and detecting power outputs. In the steady state a power error is reduced to zero.

The detecting means 67 detects the pressure of steam in the impulse chamber of the high pressure turbine 21'. When the megawatt demand is less than 25% maximum power output and steam flows through the bypass lines 25' and 57', the detecting means 67 converts the detected impulse chamber steam pressure to an output signal that represents the power output of the high pressure turbine 21'. When the megawatt demand exceeds 25 maximum power output and no steam flows through the bypass lines 25' and 57', the detecting means 67 converts the detected impulse chamber steam pressure to an output signal that represents the power output of the turbine system comprising the turbines 21', 45' and 47'. The power output of the high pressure turbine 21' is related to the difference between the detected impulse chamber steam pressure and the steam pressure at the high pressure turbine exhaust. The detected pressure of steam in the impulse chamber may be converted to a signal that represents the power output of the high pressure turbine 21' by subtracting a constant value from the detected impulse chamber steam pressure, and generating turbine 21' that is in proportion to the pressure difference. The constant value represents the average pressure of steam at the exhaust of the high pressure turbine 21' at times when steam flows through the bypass lines 25' and 57'. Although the steam pressure at the outlet of the reheater 17' is regulated at a constant value when steam flows through the bypass line 57', the pressure difference between the exhaust of the high pressure turbine 21' and the outlet of the reheater 17' may vary. Therefore, the steam pressure at the high pressure turbine exhaust may vary at times when steam flows through the bypass lines 25' and 57'. The power output of the high pressure turbine 21' may be represented with greater accuracy by detecting the pressure of steam at the exhaust of the high pressure turbine, subtracting that detected pressure from the detected pressure of steam in the impulse chamber of the high pressure turbine and generating the signal representative of the power output of the high pressure turbine in proportion to the difference of detected pressures. At times when no steam flows through the bypass lines 25' and 57' and the valve 49' is fully opened, the power output of the turbine system is linearly related to the detected pressure of steam in the impulse chamber of the high pressure turbine 21'.

The detecting means 69 is connected to detect the pressure of steam in the first stage of the intermediate pressure turbine 45'. The detected first stage steam pressure is linearly related to the combined power output of the intermediate pressure turbine 45' and the low pressure turbine 47'. The signal that represents the combined power output of such turbines therefore is proportional to the detected first stage pressure. Although the output signal of the detecting means 69 represents the combined power output of the turbine 45' and 47' at all times during the operation of the turbine system, such output signal is utilized for purposes of positioning the valve 49' only when steam flows through the bypass line 57', as previously discussed.

TURBINE LOAD CONTROL WITH ALTERNATE BYPASS VALVE CONTROL

Figure 4:
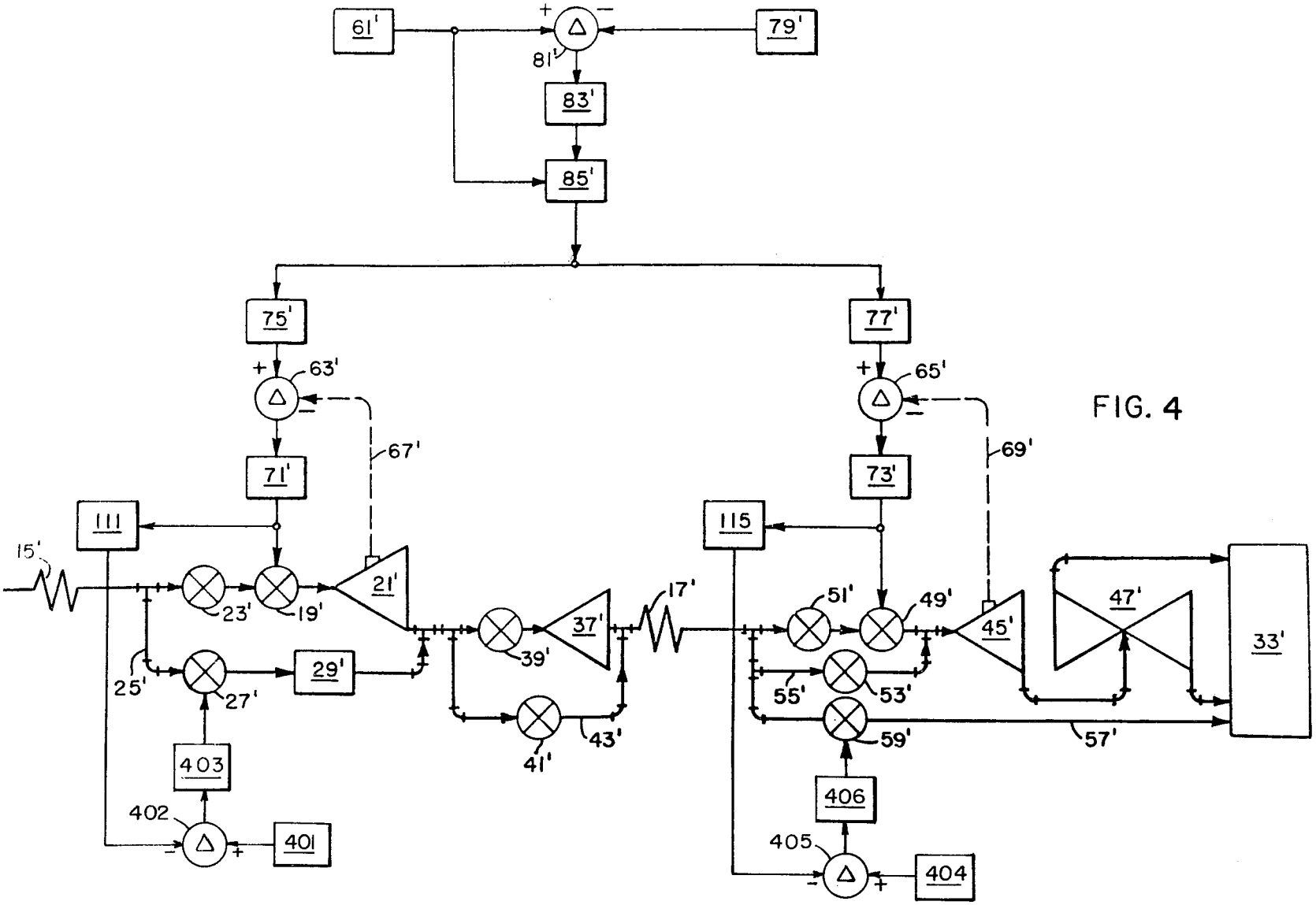
FIG. 4 is a schematic illustration of a third embodiment of the present invention.

Referring now to FIG. 4 there is shown another embodiment of an arrangement for controlling the loading of the turbine system comprising the turbines 21', 45' and 45', in which the position controls of the bypass valves 27' and 59' differ from such controls shown in FIGS. 2 and 3. A reference source 401 generates a constant output signal that is transmitted to a comparator 402. The output signal of the equalizing means 111 also is transmitted to the comparator 402. The output signal of the comparator 402 represents a desired position of the bypass valve 27'. A valve positioning means 403 positions the bypass valve 27' according to the output signal of the comparator 402.

A reference source 404 generates a constant signal that is transmitted to a comparator 408. The output signal of the equalizing means 115 also is transmitted to the comparator 405. The output signal of the comparator 405 represents a desired position of the bypass valve 59'. A valve positioner 406 positions the valve 59' in accordance with the output signal of the comparator 405.

Prior to initial loading a small steam flow passes through the turbine 21' to maintain synchronous speed, and the position of the valve 19' is transmitted through the equalizing means 111 to the comparator 402, which substracts the output signal of the equalizing means 111 from the constant signal that is generated by the reference source 401, and transmits a signal representing the difference to the valve positioner 403. When the valve 27' is positioned according to such difference, the total flow through the turbine 21' and the bypass line 25' is effectively equal to the desired minimum flow, assuming that the steam pressure at the outlet of the steam generator 15' is controlled (by means not shown) at a value that corresponds to the desired minimum flow through the steam generator.

Prior to initial loading a small steam flow passes through the turbines 45' and 47'. The position of the valve 49' is transmitted through the equalizing means 115 to the comparator 405, which substracts the output signal of the equalizing means from the constant signal that is generated by the reference source 404, and transmits a signal representing the difference to the valve positioner 406. When the valve 59' is positioned according to such difference, the total flow through the turbine 45' and through the bypass line 57' is equal to the desired minimum flow through the reheater 17', assuming that the steam pressure at the outlet of the reheater 17' is controlled (by means not shown) at a value that corresponds to the desired minimum flow through the reheater.

As the megawatt demand signal from the input means 61 increases, the values 19' and 49' are increasingly opened as previously described. When the megawatt demand is equal to 25% maximum plant power output, the valve 49' is fully open and the valve 19' is partially opened to a predetermined position, provided that the steam pressures at the outlets of the steam generator 15' and of the reheater 17' are maintained (by controls not shown) at those pressure values that correspond to the desired minimum flow through the steam generator and through the reheater. When such conditions prevail, the output signal of the equalizing means 111 is equal to the output signal of the reference source 401, and the valve positioner 403 closes the bypass valve 27' in accordance with the zero output signal of the comparator 402. Similarly the output signal of the equalizing means 115 is equal to the output signal of the reference source 404, and the bypass valve 59' is closed by the valve positioner 406 in accordance with the zero output signal of the comparator 405. Above 25% megawatt demand, the valve 49' is held open as previously discussed, and the valve 59' consequently is held closed by the positioner 406 in response to the zero output signal from the comparator 405. Above 25% megawatt demand, the output signal of the equalizing means 111 exceeds the output signal of the reference source 401, and the valve positioner 403 is arranged to hold the bypass valve 27' closed under such conditions. Between megawatt demands of 0 and 25%, the positions of the valves 19' and 49' increase with increasing megawatt demand. Thus the output signals of the equalizing means 111 and 115 increase and the output signals of the comparators 402 and 405 correspondingly decrease with increasing megawatt demand. In response the valve positioners 403 and 406 increasingly close the bypass valves 27' and 59' as the megawatt demand increases.

The control arrangements shown in FIGS. 2 and 3 position the bypass valves 27' and 59' to maintain reference values of the steam pressures at the outlets of the steam generator 15' and the reheater 17'. In the arrangement of FIG. 4, the control of such pressures is performed by other controls (not shown). Control of the bypass valves 27' and 59' to maintain reference values of steam pressures at the outlets of the steam generator 15' and of the reheater 17' preferably minimizes transient movement of the valves 19' and 49' and minimizes transient power errors between the desired and the detected power output of the turbine system that may result from deviation of such steam pressures.

DIGITAL COMPUTER IMPLEMENTATION OF HTGR TURBINE LOAD CONTROL

Figure 5:
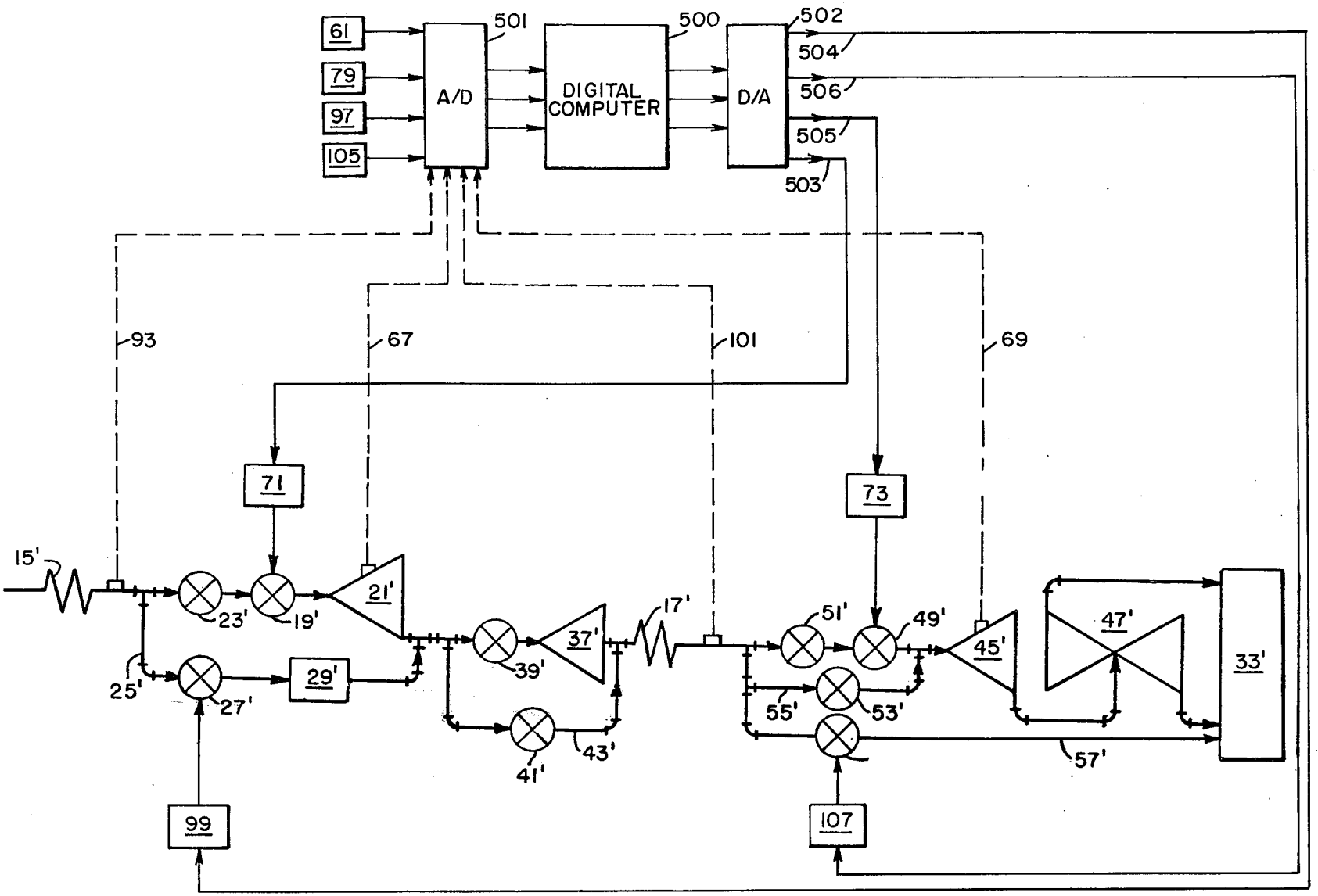
FIG. 5 is a schematic illustration of a fourth embodiment of the present invention.

FIG. 5 shows a further embodiment of the control arrangement of FIG. 2 that utilizes a digital computer 500 that is associated with an analog to digital (A/D) converter 501, and with a digital to analog (D/A) converter 502. The megawatt demand signal from the input means 61, the signal representing the detected power output of the generator 79, and the pressure reference signals from the sources 97 and 105 are connected to inputs of the A/D converter 501. Also connected to inputs of the A/D converter 501 are the power output signals of the detecting means 67 and 69 and the pressure signals from the detecting means 93 and 101. The input signals of the A/D converter 501 are scanned periodically for entry into the computer. During one such scan the analog value of each input signal is converted to a digital representation that is stored in memory of the digital computer 500. Periodically the digital computer 500 uses the digital values of the scanned input signals to calculate digital power errors and digital pressure errors. Each calculated error is converted to an analog signal by the D/A converter 502. A power error signal is transmitted to the regulating means 71 on a line 503, and a power error signal is transmitted to the regulating means 73 on a line 505. A pressure error signal is transmitted to the regulating means 99 on a line 504, and a pressure error signal is transmitted to the regulating means 107 on a line 506. Because the operations of analog to digital conversion, digital program execution, and digital to analog conversion are performed periodically, the D/A converter 501 must hold the output signals on the lines 503–506 at constant levels during intervals between the periodic calculations of the above-mentioned digital power errors and digital pressure errors. This is accomplished by utilizing a digital to analog converter capable of storing the most recently calculated digital inputs, or by utilizing a converter that is capable of holding the analog values of the most recently calculated digital inputs.

In the digital computer 500 the digital representation of the detected power output of the generator 79 is subtracted from the digital representation of the megawatt demand, to generate a digital representation of the heretofore described power error. The digital representation of the power error is passed to a digital integration subroutine which numerically integrates the power error. The digital representation of the megawatt demand is multiplied by the digital representation of the integrated power error, the product being a digital representation of the required power.

The required power representation is used to calculate digital representations of the power demands related to the turbine 21' and to the turbines 45' and 47'. When the bypass valves 27' and 59' are open, the required power is split into first and second digital power demand representations whose sum is the required power. The digital representation of the power output of the turbine 21' is subtracted from the first power demand representation to generate a first power error representation that determines the position of the valve 19'. The first power error representation is converted by the D/A converter 502, and the analog value that corresponds to the first power error representation is transmitted on the line 503 to the regulating means 71, which positions the valve 19' in accordance with such analog value. Similarly the digital representation of the combined power output of the turbines 45' and 47' is subtracted from the second power demand representation to generate a second power error representation that determines the position of the intercept valve 49'. The second power error representation is converted by the D/A converter 502 to an analog signal that is transmitted on the line 505 to the regulating means 73, which positions the valve 49' in accordance with the analog value of the second power error representation. The first and second power demands are such that the steam flows through the turbines 21' and 45' are equal when the first and second power error representations are zero and the bypass valves 27' and 59' are open.

When the bypass valves 27' and 59' are closed the second power demand representation is of such value that the regulating means 73 holds the valve 49' fully open in response to the analog value of the second power error representation. At such times, the required power and the first power demand representation are equated in the digital computer 500, whereby the power output of the turbine system is controlled by the valve 19', as positioned by the regulating means 71 in accordance with the analog value of the first power error representation. When the bypass valves 27' and 59' are closed, the digital representation of the power output of the turbine system as detected by the detecting means 67 is subtracted from the first power demand to generate the first power error representation.

The pressure reference signal from the reference source 97 and the output signal of the pressure detecting means 93 are converted to digital representations by the analog to digital converter 501. The digital representation of the detected pressure is subtracted from the digital representation of the reference pressure to generate a first pressure error representation that is converted by the digital to analog converter 502. The regulating means 99 positions the bypass valve 27' in accordance with the signal on the line 504 which represents the analog value of the first pressure error. Alternately the digital representation of the pressure reference value (when the megawatt demand is less than 25% maximum power output) may be stored as a constant in the digital computer 500, in which case the pressure reference source 97 is not used. If the pressure reference source 97 is not used, another constant is stored in the digital computer 500 for utilization as the digital representation of the pressure reference when the megawatt demand exceeds 25%, the pressure reference that is used at such megawatt demand levels being greater than the greatest digital representation of the pressure detected by the detecting means 93, to ensure that the bypass valve 27' is held closed at megawatt demands in excess of 25%.

The pressure reference signal from the reference source 105 and the output signal of the pressure detecting means 101 are converted to digital representations by the analog to digital converter 501. The digital representation of the difference between such reference and detected pressure values is generated in the computer 500 and converted by digital to analog converter 502, which transmits the analog value of such difference to the regulating means 107 on the line 506. The regulating means 107 positions the bypass valve 59' in accordance with the analog value of the digital pressure error. Alternately, the digital representation of the pressure reference may be stored in the digital computer in the form of two constants, in which case the pressure reference source 105 is not required. The first such stored constant is the digital representation of the pressure reference value when the megawatt demand is less than 25% maximum plant power. The second such stored constant is the digital representation of the pressure reference when the megawatt demand exceeds 25%. The value of the second stored constant exceeds the greatest value of the digital representation of the signal generated by the pressure detecting means 101 over the full range of megawatt demands, to cause the regulating means 107 to hold the bypass valve 59' closed between megawatt demands of 25% and 100%.

The digital computer 500 and its associated converters 501 and 502 may be connected and utilized as in FIG. 5 to implement the control arrangement shown in FIG. 3, if the elements 109, 111, 113 and 115 of FIG. 3 are analog elements that are connected outside the digital computer and its converters. The connection of the digital computer 500 and its associated converters 501 and 502 as shown in FIG. 5 may be modified to implement the control arrangement shown in FIG. 4. In such case the signals from the elements 97, 93, 101, and 105 are disconnected from the inputs of the A/D converter 501 and the output lines 504 and 506 of the D/A converter 502 are not used. The elements 401–406 shown in FIG. 4 are analog elements that are connected outside the digital computer and its converters. The digital computer 500 thus performs no calculations with respect to positioning the bypass valves 27' and 59'; rather such values are positioned by the valve positioners 403 and 406 in accordance with the output signals of the comparators 402 and 405 shown in FIG. 4.

It should be understood that various modifications, changes and variations may be made in the arrangement, operations adn details of construction of the elements disclosed herein without department from the spirit and scope of the present invention.

I claim:

1. In a turbine system having a first turbine stage with a first flow valve to determine the flow therethrough, a first bypass line with a first bypass valve therein connected across the first turbine stage and the first flow valve, a second turbine stage with a second flow valve to determine the flow therethrough, and a second bypass line with a second bypass valve therein connected across the second turbine stage and the second flow valve, an improved control arrangement for simultaneously administering the loading of the first and second turbine stages comprising:

input means providing an input signal indicative of the power requirements of the turbine system;

first detecting means providing a first power signal indicative of the power output of the first turbine stage;

first comparing means for detecting the difference between the power requirements indicated by said input signal and the power output of the first turbine stage indicated by said first power signal and providing a first error signal indicative thereof;

first regulating means to adjust the first flow valve in response to said first error signal;

first compensating means to adjust the first bypass valve in response to adjustment of the first flow valve to produce an effect on the flow through the bypass line that is the inverse of the effect produced on the flow through the first turbine stage by adjustment of the first flow valve;

second detecting means providing a second power signal indicative of the power output of the second turbine stage;

second comparing means for determining the difference between the power requirements indicated by said input signal and the power output of the second turbine stage indicated by said second power signal and providing a second error signal indicative thereof;

second regulating means to adjust the second flow valve in response to said second error signal; and second compensating means to adjust the second bypass valve in response to adjustment of the second flow valve to produce an effect on the flow through the second bypass line that is the inverse of the effect produced on the flow through the second turbine stage by adjustment of the second flow valve.

2. A control arrangement as claimed in claim 1 and further comprising correlating means to cause the adjustments made by said first and second regulating means to offset non-linearities in the system.

3. A control arangement as claimed in claim 2 wherein said correlating means comprises:

a first function generator connected to convey said input signal to said first comparing means; and a second function generator connected to convey said input signal to said second comparing means, said first and second function generators modifying said input signal to offset non-linearities in the system.

4. A control arrangement as claimed in claim 2 and further comprising timing means to cause said first and second regulating means to continue adjustment of said first and second flow valves, respectively, until the turbine system generates the power requirements indicated by said input signal.

5. A control arrangement as claimed in claim 1 wherein:

said first detecting means comprises a first transducer in which a power related parameter of the first turbine stage is measured and the measurement is converted into said second power signal; and said second detecting means comprises a second transducer in which a power related parameter of the second turbine stage is measured and the measurement is converted into said second power signal.

6. A control arrangement as claimed in claim 1 wherein;

said first regulating means comprises a first transfer circuit that transforms said first error signal into a first control signal for adjustment of the physical setting of the first flow valve; and said second regulating means comprises a second transfer circuit that transforms said second error signal into a second control signal for adjustment of the physical setting of the second flow valve.

7. A control arrangement as claimed in claim 1, wherein said first and second compensating means comprises third detecting means providing a third error signal indicative of a change in the operating conditions of the first turbine stage;

third regulating means to adjust the first bypass valve in response to said third error signal;

fourth detecting means providing a fourth error signal indicative of a change in the operating conditions of the second turbine stage; and fourth regulating means to adjust the second bypass valve in response to said fourth error signal.

8. A control arrangement as claimed in claim 7 wherein:

said third detecting means comprises a third transducer and a third comparing means to measure and convert the measurement of a parameter of the first turbine stage into a signal, to determine the difference between such signal and a signal representing a reference level for that parameter, and to produce said third error signal therefrom; and said fourth detecting means comprises a fourth transducer and fourth comparing means to measure and convert the measurement of a parameter of the second turbine stage into a signal, to determine the difference between such signal and a signal representing a reference level for that parameter, and to produce said fourth error signal therefrom.

9. A control arrangement as claimed in claim 7 and further comprising:

fifth comparing means to determine the difference between the output of said first regulating means and the output of said third regulating means and provide a modified third control signal to adjust the first bypass valve; and sixth comparing means to determine the difference between the output of said second regulating means and the output of said fourth regulating means and provide a modified fourth control signal to adjust the second bypass valve.

10. A control arrangement as claimed in claim 9 and further comprising:

first equalizing means to cause the output of said first regulating means to be compatible with the output of said third regulating means; and second equalizing means to cause the output of said second regulating means to be compatible with the output of said fourth regulating means.

11. A control arrangement as claimed in claim 10 and further comprising:

a first function generator connected to receive said input signal and convey a first modified input signal to said first comparing means; and a second function generator connected to receive said input signal and convey a second modified input signal to said second comparing means, said first and second modified input signals causing non-linearities in the system to be offset.

12. A control arrangement as claimed in claim 11 and further comprising timing means to modify said input signal if the power generated by the system does not conform to the power requirements indicated by said input signal within a predetermined time after initial production of said input signal by said input means.

13. A control arrangement as claimed in claim 12 wherein:

said first detecting means comprises a first transducer in which a power related parameter of the first turbine stage is measured and converted into said first power signal;

said second detecting means comprises a second transducer in which a power related parameter of the second turbine stage is measured and converted into said second power signal;

said first regulating means comprises a first transfer circuit that transforms said first error signal into a first control signal for adjustment of the physical setting of the first flow valve;

said second regulating means comprises a second transfer circuit that transforms said second error signal into a second control signal for adjustment of the physical setting of the second flow valve;

said third detecting means comprises a third transducer and a third comparing means to measure and convert the measurement of a parameter of the first turbine stage into a signal, to determine the difference between such signal and a signal representing a reference level for that parameter, and to produce said third error signal therefrom;

said fourth detecting means comprises a fourth transducer and a fourth comparing means to measure and convert the measurement of a parameter of the first turbine stage into a signal, to determine the difference between such signal and a signal representing a reference level for that parameter, and produce said fourth error signal therefrom;

said third regulating means comprises a third transfer circuit that transforms said third error signal into a third control signal for adjustment of the physical setting of the first bypass valve, said third control signal being applied to said fifth comparing means; and said fourth regulating means comprises a fourth transfer circuit that transforms said fourth error signal into a fourth control signal for adjustment of the physical setting of the second bypass valve, said fourth control signal being applied to said sixth comparing means.

14. A control arrangement as claimed in claim 1 and further comprising timing means to cause said first and second regulating means to continue adjustment, respectively, of said first and second flow valves until the turbine system produces the power requirements indicated by said input signal.

15. A control arrangement as claimed in claim 14 wherein said timing means compares said input signal and a signal indicating the power generated by the turbine system and modifies said input signal as applied to first and second comparing means if the power generated by the turbine system does not conform to the power requirements indicated by said input signal.

16. A control arrangement as claimed in claim 14 wherein said first and second compensating means comprise:

third comparing means for producing a third error signal indicative of the difference between a signal representing a parameter of the first turbine stage and a signal representing a reference level for that parameter;

third regulating means to adjust the first bypass valve in response to said third error signal;

fourth comparing means for producing a fourth error signal indicative of the difference between a signal representing a parameter of the second turbine stage and a signal representing a reference level for that parameter; and fourth regulating means to adjust the second bypass valve in response to said fourth error signal.

17. A control arrangement as claimed in claim 16 and further comprising:

first equalizing means to cause the output of said first regulating means to be compatible with the output of said third regulating means;

fifth comparing means to determine the difference between the output of said first equalizing means and the output of said third regulating means and modify the adjustment of the first bypass valve accordingly;

second equalizing means to cause the output of said second regulating means to be compatible with the output of said fourth regulating means; and sixth comparing means to determine the difference between the output of said second equalizing means and the output of said fourth regulating means and modify the adjustment of the second bypass valve accordingly.

18. In a steam turbine system having a high pressure turbine with a main steam control valve to determine steam flow therethrough, a main steam bypass line with a main steam bypass valve therein connected across the high pressure turbine and the main steam control valve, intermediate pressure and low pressure turbines with an interceptor valve to determine the steam flow therethrough and a hot reheat bypass line with a hot reheat bypass valve therein connected across the intermediate and low pressure turbines and the interceptor valve, an improved control arrangement for simultaneously administering the loading of the high pressure turbine and intermediate and low pressure turbines comprising:

input means providing an input signal indicative of the power requirements of the turbine system;

a first function generator connected to said input means;

a first pressure transducer to measure the pressure in the high pressure turbine and convert the pressure reading into a first power signal indicative of the power output of the high pressure turbine;

first comparing means connected to said first function generator and said first pressure transducer to determine the difference between said first power signal and said input signal as modified by said first function generator and to provide a first error signal indicative thereof;

a first transfer circuit connected to said first comparing means to transform said first error signal into a first control signal for adjustment of the physical setting of the main steam control valve;

first compensating means to adjust the main steam bypass valve in response to adjustment of the main steam control valve to produce an effect in the flow through the main steam bypass line that is the inverse of the effect produced on the flow through the high pressure turbine by adjustment of the main steam control valve;

a second function generator connected to said input means, said first and second function generators adapted to modify said input signal to offset nonlinearities in the system;

a second pressure transducer to measure the pressure in the intermediate pressure turbine and convert the pressure reading into a second power signal indicative of the power output of the intermediate and low pressure turbines;

second comparing means connected to said second function generator and said second pressure transducer to determine the difference between said second power signal and said input signal as modified by said second function generator and to provide a second error signal indicative thereof;

a second transfer circuit connected to said second comparing means to transform said second error signal into a second control signal for adjustment of the physical setting of the interceptor valve; and second compensating means to adjust the hot reheat bypass valve in response to adjustment of the interceptor valve to produce an effect on the flow through the low reheat bypass line that is the inverse of the effect produced on the flow through the intermediate and low pressure turbines by adjustment of the interceptor valve.

19. A control arrangement as claimed in claim 18 and further comprising timing means for comparing the power output of the turbine system with the power requirement indicated by said input signal and causing said input signal as applied to said first and second function generators to be modified if the power generated by the system does not conform to the power requirement indicated by said input signal.

20. A control arrangement as claimed in claim 19 wherein said first and second compensating means comprise:

a third pressure transducer to measure the pressure upstream of the main steam control valve and the high pressure turbine and provide a signal representative thereof;

a first pressure reference source to provide a signal representative of a reference level at the point where the pressure is measured by said third pressure transducer;

a third comparing means connected to said third pressure transducer and said first pressure reference source to determine the difference between the signals therefrom and provide a third signal indicative of a desired change in the pressure at the point where the pressure is measured by said third pressure transducer;

a third transfer circuit connected to said third comparing means to transform said third error signal into a third control signal for adjustment of the physical setting of the main steam bypass valve;

a fourth pressure transducer to measure the pressure upstream of the interceptor valve and the intermediate pressure turbine and provide a signal representative thereof;

a second pressure reference source to provide a signal representative of a reference pressure level at the point where the pressure is measured by said fourth pressure transducer;

a fourth comparing means connected to said fourth pressure transducer and said second pressure reference source to determine the difference between the signals therefrom and provide a fourth error signal indicative of a desired change in the pressure at the point where the pressure is measured by said fourth pressure transducer; and a fourth transfer circuit connected to said fourth comparing means to transform said fourth error signal into a fourth control signal for adjustment of the physical setting of the hot reheat bypass valve.

21. A control arrangement as claimed in claim 20 and further comprising:

fifth comparing means to determine the difference between said first control signal and said third control signal and to provide a modified third control signal to adjust the main steam bypass valve in response to the power requirements indicated by said input signal;

first equalizing means connected between said first transfer circuit and said fifth comparing means to cause said first control signal to be compatible with said third control signal;

sixth comparing means to determine the difference between said second control signal and said fourth control signal and to provide a modified fourth control signal to adjust the hot reheat bypass valve in response to the power requirement indicated by said input signal; and second equalizing means connected between said second transfer circuit and said sixth comparing means to cause said second control signal to be compatible with said third control signal.

22. A control arrangement as claimed in claim 21 wherein said timing means comprises:

seventh comparing means to determine the difference between said input signal and a signal representing the power output of the turbine system;

an integrator circuit to integrate the output of said seventh comparing means; and a multiplier circuit to modify said input signal in response to the output of said integrator circuit.

23. A system for controlling the power output of a turbine-generator in a power plant that includes a steam source to derive heat from the coolant gas of the high temperature nuclear reactor to generate superheated and reheated steam in respective first and second steam passage portions, said turbine at least including a high pressure turbine and lower pressure turbine, first valve means connected to govern a first steam flow from the outlet of the first steam passage portion to the inlet of the high pressure turbine, a first bypass line connected across the first valve means and the high pressure turbine, second valve means connected to govern a second steam flow from the outlet of the second steam passage portion to the inlet of the lower pressure turbine, a second bypass line connected across the second valve means and the lower pressure turbine, first and second bypass valve means connected to control the steam flows through the respective first and second bypass lines, and auxiliary steam turbine means connected to use at least a portion of the steam flow from the exhaust of the high pressure turbine to the inlet of the second steam passage portion and rotatably coupled to drive a means for circulating the coolant gas through the reactor and the steam source, said control system comprising, means to generate a representation of the desired power output of the turbine-generator, means to position the first and second valve means to vary the first and second steam flows to control the combined power output of the high and lower pressure turbines in accordance with the representation of the desired power output of the turbine-generator, means responsive to a first power plant variable to position the first bypass valve means to compensate a change of the first steam flow by an equal, but opposite, change of the flow through the first bypass line, and means responsive to a second power plant variable to position the second bypass valve means to compensate a change of the second steam flow by an equal, but opposite, change of the flow through the second bypass line.

24. A control system according to claim 23 wherein the first and second steam flows are equal at times when such flows are less than or equal to the desired minimum flow.

25. A control system according to claim 24 wherein the second valve means is fully open when the first and second steam flows are equal to the desired minimum flow.

26. A control system according to claim 23 wherein the means to position the first and second valve means include, means to generate a representation of a desired power output of the high pressure turbine in response to the representation of the desired power output of the turbine-generator, means to generate a representation of a desired power output of the lower pressure turbine in response to the representation of the desired power output of the turbine-generator, the sum of the desired power output of the high pressure turbine with the desired power output of the lower pressure turbine being in accordance with the desired power output of the turbine-generator, means to position the first valve means to vary the first steam flow in accordance with the representation of the desired power output of the high pressure turbine, and means to position the second valve means to vary the second steam flow in accordance with the representation of the desired power output of the lower pressure turbine.

27. A control system according to claim 26 wherein the first and second steam flows are equal at times when such flows are less than or equal to the desired minimum flow.

28. A control system according to claim 27 wherein the second valve means is fully open when the first and second steam flows are equal to the desired minimum flow.

29. A control system according to claim 23 wherein the first power plant variable is the steam pressure at the outlet of the first steam passage portion, and the second power plant variable is the steam pressure at the outlet of the second stage passage portion.

30. A control system according to claim 23 wherein the first power plant variable is the position of the first valve means, and the second power plant variable is the position of the second valve means.

31. A system for controlling the power output of a turbine-generator in a power plant that includes a steam source to derive heat from the coolant gas of the high temperature nuclear reactor to generate superheated and reheated steam in respective first and second steam passage portions, said turbine at least including a high pressure turbine and a lower pressure turbine, first valve means connected to govern a first steam flow from the outlet of the first steam passage portion to the inlet of the high pressure turbine, a first bypass line connected across the front valve means and the high pressure turbine, second valve means connected to govern a second steam flow from the outlet of the second steam passage portion to the inlet of the lower pressure turbine, a second bypass line connected across the second valve means and the lower pressure turbine, first and second bypass valve means connected to control the steam flows through the respective first and second bypass lines, and auxiliary steam turbine means connected to use at least a portion of the steam flow from the exhaust of the high pressure turbine to the inlet of the second steam passage portion and rotatably coupled to drive a means for circulating the coolant gas through the reactor and the steam source, said control system comprising, means to generate a representation of a desired power output of the turbine-generator, means to generate a representation of a desired power output of the high pressure turbine in response to the representation of the desired power output of the turbine-generator, means to generate a representation of a desired power output of the lower pressure turbine in response to the representation of the desired power output of the turbine-generator, the sum of the desired power output of the high pressure turbine with the desired power output of the lower pressure turbine being in accordance with the desired power output of the turbine-generator, means to detect the power output of the high pressure turbine and generate a representation of the detected power output, means to detect the power output of the lower pressure turbine and generate a representation of the detected power output, means to position the first valve means in accordance with a difference between the representation of the desired and detected power output of the high pressure turbine to vary the first steam flow to reduce difference, means to position the second valve means in accordance with a difference between the representations of the desired and detected power output of the pressure turbine to vary the second steam flow to reduce the difference, means responsive to a first power plant variable to position the first bypass valve means to compensate a change of the first steam flow by an equal, but opposite change of the flow through the first bypass line, and means responsive to a second power plant variable to position the second bypass valve means to compensate a change of the second steam flow by an equal, but opposite, change of the flow through the second bypass line.

32. A control system according to claim 31 wherein the first and second steam flows are equal at times when such flows are less than or equal to the desired minimum flow.

33. A control system according to claim 32 wherein the second valve means is fully open when the first and second steam flows are equal to the desired minimum flow.

34. A control system according to claim 31 wherein the first valve means is positioned in accordance with a signal comprising the sum of a first component that is proportional to a difference between the representations of the detected and desired power output of the high pressure turbine with a second component that is proportional to the time integral of such difference, and the second valve means is positioned in accordance with a signal comprising the sum of a first component that is proportional to a difference between the representations of the desired and detected power output of the lower pressure turbine with a second component that is proportional to the time integral of such difference.

35. A control system according to claim 31 wherein the means to position the first bypass valve means comprise, means to generate a representation of a desired steam pressure at the outlet of the first steam passage portion that corresponds to a desired minimum flow through the first steam passage portion, means to detect the steam pressure at the outlet of the first steam passage portion and generate a representation of the detected steam pressure, and means to position the first bypass valve means in accordance with a difference between the representations of the detected and desired steam pressure at the outlet of the first steam passage portion to reduce the difference, and wherein the means to position the second bypass valve means comprise, means to generate a representation of a desired steam pressure at the outlet of the second steam passage portion that corresponds to a desired minimum steam flow through the second steam passage portion, means to detect the steam pressure at the outlet of the second steam passage portion and generate a representation of the detected pressure, and means to position the second bypass valve means in accordance with a difference between the representations of the detected and desired steam pressure at the outlet of the second steam passage portion to reduce the difference.

36. A control system according to claim 35 wherein the first and second steam flows are equal when such flows are less than or equal to the desired minimum flow, and the second valve means is fully open when the steam flows are equal to the desired minimum flow.

37. A control system according to claim 31 wherein the first bypass valve means is positioned in inverse relation to the position of the first valve means, whereby a change of the first steam flow is compensated by an equal, but opposite, change of the flow through the first bypass line, and the second bypass valve means is positioned in inverse relation to the position of the second valve means, whereby a change of the second steam flow is compensated by an equal, but opposite, change of the flow through the second bypass line.

38. A control system according to claim 37 wherein the first and second steam flows are equal when such flows are less than or equal to the desired minimum flow, and the second valve means is fully open when such steam flows are equal to the desired minimum flow.

39. A system for controlling the power output of a turbine-generator in a power plant that includes a steam source to derive heat from the coolant gas of a high temperature nuclear reactor to generate superheated and reheated steam in respective first and second steam passage portions, said turbine at least including a high pressure turbine and a lower pressure turbine, first valve means connected to govern a first steam flow from the outlet of the first steam passage portion to the inlet of the high pressure turbine, a first bypass line connected across the first valve means and the high pressure turbine, second valve means connected to govern a second flow of steam from the outlet of the second steam passage portion to the inlet of the lower pressure turbine, a second bypass line connected across the second valve means and the lower pressure turbine, first and second bypass valve means connected to control the steam flows through the respective first and second bypass lines, and auxiliary steam turbine means connected to use at least a portion of the steam flow from the exhaust of the high pressure turbine to the inlet of the second steam passage portion and rotatably coupled to drive a means for circulating the coolant gas through the reactor and the steam source, said control system comprising, means to generate a first representation of a desired power output of the turbine-generator, means to detect the power output of the turbine-generator and generate a second representation of the detected power output, means to position the first and second valve means to vary the first and second steam flows to reduce a difference between the first and second representations, means responsive to a first power plant variable to position the first bypass valve means to compensate a change of the first steam flow by an equal, but opposite, change of the flow through the first bypass line, and means responsive to a second power plant variable to position the second bypass valve means to compensate a change of the second steam flow by an equal, but opposite, change of the flow through the second bypass line.

40. A control system according to claim 39 wherein the first and second steam flows are equal when such flows are less than or equal to the desired minimum flow, and the second valve means is fully open when such flows are equal to the desired minimum flow.

41. A control system according to claim 39 wherein the means to position the first and second valve means include, means to generate a third representation of the time integral of the difference between the representations of the detected and desired power output of the turbine-generator, and means responsive to the first and the third representations to position the first and second valve means in accordance with the product of the time integral of the difference between the detected and desired power output of the turbine-generator with the desired power output.

42. A control system according to claim 41 wherein the means responsive to the first and third representations comprise, means responsive to the first and third representations to generate a fourth representation of the product of the time integral of the difference between the detected and desired power output of the turbine-generator with the desired power output, means responsive to the fourth representation to generate a fifth representation of a desired power output of the high pressure turbine and a sixth representation of a desired power output of the lower pressure turbine, the sum of the fifth representation with the sixth representation being equal to the fourth representation, means to detect the power output of the high pressure turbine and generate a seventh representation of the detected power output, means to detect the power output of the lower pressure turbine and generate an eighth representation of the detected power output, means to position the first valve means in accordance with the difference between the fifth representation and the seventh representation, and means to position the second valve means in accordance with the difference between the sixth representation and the eighth representation.

43. A control system according to claim 42 wherein the steam flows through the high pressure turbine and the lower pressure turbine are equal when such flows are less than or equal to the desired minimum flow, and the second valve means is fully opened when the turbine steam flows are equal to the desired minimum flow.

44. A control system according to claim 39 wherein the means to position the first bypass valve means comprise, means to generate a representation of a desired steam pressure at the outlet of the first steam passage portion that corresponds to a desired minimum flow through the first steam passage portion, means to detect the steam pressure at the outlet of the first steam passage portion and generate a representation of the detected steam pressure, and means to position the first bypass valve means in accordance with a difference between the representations of the detected and desired steam pressure at the outlet of the first steam passage portion to reduce the difference, and wherein the means to position the second bypass valve means comprise, means to generate a representation of a desired steam pressure at the outlet of the second steam passage portion that corresponds to a desired minimum steam flow through the second steam passage portion, means to detect the steam pressure at the outlet of the second steam passage portion and generate a representation of the detected pressure, and means to position the second bypass valve means in accordance with a difference between the representations of the detected and desired steam pressure at the outlet of the second steam passage portion to reduce the difference.

45. A control system according to claim 39 wherein the first bypass valve means is positioned in inverse relation to the position of the first valve means, whereby a change of the first steam flow is compensated by an equal, but opposite, change of the flow through the first bypass line, and the second bypass valve means is positioned in inverse relation to the position of the second valve means, whereby a change of the second steam flow is compensated by an equal, but opposite, change of the flow through the second bypass line.

46. A power plant that includes a steam source to derive heat from the coolant gas of a high temperature nuclear reactor to generate superheated and reheated steam in respective first and second steam passage portions, the coolant gas being circulated through the reactor and the steam source by a gas circulating means, said power plant comprising, electric generating means, a steam turbine rotatably coupled to drive said electric generating means, said steam turbine at least including a high pressure turbine and a lower pressure turbine, first valve means connected to control a first steam flow from the outlet of the first steam passage portion to the inlet of the high pressure turbine, a first bypass line connected between the outlet of the first steam passage portion and the exhaust of the high pressure turbine to permit a desired minimum flow through the first steam passage portion when the first steam flow is less than such minimum, first bypass valve means connected to control the steam flow through the first bypass line, second valve means connected to control a second steam flow from the outlet of the second steam passage portion to the inlet of the lower pressure turbine, a second bypass line connected between the outlet of the second steam passage portion and the exhaust of the lower pressure turbine to permit a desired minimum flow through the second steam passage portion when the second flow is less than such minimum, second bypass valve means connected to control the steam flow through the second bypass line, auxiliary steam turbine means connected to pass at least a portion of the steam flow from the exhaust of the high pressure turbine to the inlet of the second steam passage portion and rotatably coupled to drive the reactor coolant gas circulating means, means to generate a representation of the desired power output of the turbine-generator, means to position the first and second valve means to vary the first and second steam flows to control the combined power output of the high and lower pressure turbines in accordance with the representation of the desired turbine-generator power output, means responsive to a first power plant variable to position the first bypass valve means to compensate a change of the first steam flow by an equal, but opposite change of the flow through the first bypass line, and means responsive to a second power plant variable to position the second bypass valve means to compensate a change of the second steam flow by an equal, but opposite, change of the flow through the second bypass line.

47. A power plant according to claim 46 wherein the first and second steam flows are equal when such flows are less than the desired minimum flow, and the second valve means is fully open when such flows are equal to the desired minimum flow.

48. A power plant according to claim 46 wherein the means to position the first and second valve means include, means to generate a representation of a desired power output of the high pressure turbine in response to the representation of the desired power output of the turbine-generator, means to generate a representation of a desired power output of the lower pressure turbine in response to the representation of the desired power output of the turbine-generator, the sum of the desired power output of the high pressure turbine with the desired output of the lower pressure turbine being in accordance with the desired power output of the turbine-generator, means to position the first valve means to vary the first steam flow in accordance with the representation of the desired power output of the high pressure turbine, and means to position the second valve means to vary the second steam flow in accordance with the representation of the desired power output of the lower pressure turbine.

49. A power plant according to claim 48 wherein the means to position the first valve means comprise, means to detect the power output of the high pressure turbine and generate a representation of the detected power output, and means to position the first valve means in accordance with a difference between the representation of the desired and detected power output of the high pressure turbine to vary the first steam flow to reduce the difference, and the means to position the second valve means comprise, means to detect the power output of the lower pressure turbine and generate a representation of the detected power output, and means to position the second valve means in accordance with a difference between the representations of the desired and detected power output of the lower pressure turbine to vary the second steam to reduce the difference.

50. A power plant according to claim 49 wherein the first valve means is positioned in accordance with a signal comprising the sum of a first component that is proportional to a difference between the representations of the detected and desired power output of the high pressure turbine with a second component that is proportional to the time integral of such difference, and the second valve means is positioned in accordance with a signal comprising the sum of a first component that is proportional to a difference between the representations of the desired and detected power output of the lower pressure turbine with a second component that is proportional to the time integral of such difference.

51. A power plant according to claim 50 wherein the first and second steam flows are equal when such flows are less than the desired minimum flow, and the second valve means is fully open when such flows are equal to the desired minimum flow.

52. A power plant according to claim 46 wherein the means to position the first bypass valve means comprise, means to generate a representation of a desired steam pressure at the outlet of the first steam passage portion that corresponds to a desired minimum flow through the first steam passage portion, means to detect the steam pressure at the outlet of the first steam passage portion and generate a representation of the detected steam pressure, and means to position the first bypass valve means in accordance with a difference between the representations of the detected and desired steam pressure at the outlet of the first steam passage portion to reduce the difference, and wherein the means to position the second bypass valve means comprise, means to generate a representation of a desired steam pressure at the outlet of the second steam passage portion that corresponds to a desired minimum steam flow through the second steam passage portion, means to detect the steam pressure at the outlet of the second steam passage portion and generate a representation of the detected pressure, and means to position the second bypass valve means in accordance with a difference between the representations of the detected and desired steam pessure at the outlet of the second steam passage portion to reduce the difference.

53. A power plant according to claim 52 wherein the first and second steam flows are equal when such flows are less than the desired minimum flow, and the second valve means is fully open when such flows are equal to the desired minimum flow.

54. A power plant according to claim 46 wherein the first bypass valve means is positioned in inverse relation to the position of the first valve means, whereby a change of the first steam flow is compensated by an equal, but opposite, change of the flow through the first bypass line, and the second bypass valve means is positioned in inverse relation to the position of the second valve means, whereby a change of the second steam flow is compensated by an equal, but opposite, change of the flow through the second bypass line.

55. A power plant that includes a steam source to derive heat from the coolant gas of a high temperature nuclear reactor to generate superheated and reheated steam in respective first and second steam passage portions, the coolant gas being circulated through the reactor and the steam source by a gas circulating means, said power plant comprising, electric generating means, a steam turbine rotatably coupled to drive said electric generating means, said turbine at least including a high pressure turbine and a lower pressure turbine, first valve means connected to control a first steam flow from the outlet of the first steam passage portion to the inlet of the high pressure turbine, a first bypass line connected between the outlet of the first steam passage portion and the exhaust of the high pressure turbine to permit a desired minimum flow through the first steam passage portion when the first steam flow is less than such minimum, first bypass valve means connected to control the steam flow through the first bypass line, second valve means connected to control a second steam flow from the outlet of the second steam passage portion to the inlet of the lower pressure turbine, a second bypass line connected between the outlet of the second steam passage portion and the exhaust of the lower pressure turbine to permit a desired minimum flow through the second steam passage portion when the second flow is less than such minimum, second bypass valve means connected to control the steam flow through the second bypass line, auxiliary steam turbine means connected to pass at least a portion of the steam flow from the exhaust of the high pressure turbine to the inlet of the second steam passage portion and rotatably coupled to drive the reactor coolant gas circulating means, means to generate a first representation of a desired power output of the turbine-generator, means to detect the power output of the turbine-generator and generate a second representation of the detected power output, means to position the first and second valve means to vary the first and second steam flows to reduce a difference between the first and second representations, means responsive to a first power plant variable to position the first bypass valve means to compensate a change of the first steam flow by an equal, but opposite change of the flow through the first bypass line, and means responsive to a second power plant variable to position the second bypass valve means to compensate a change of the second steam flows by an equal, but opposite, change of the flow through the second bypass line.

56. A power plant according to claim 55 wherein the means to position the first and second valve means include, means to generate a third representation of the time integral of the difference between the representations of the detected and desired power output of the turbine-generator, and means responsive to the first and third representations to position the first and second valve means in accordance with the product of the first and third representations.

57. A power plant according to claim 56 wherein the means responsive to the time integral and desired power output representations comprise, means responsive to the first and third representations to generate a fourth representation of the product of the time integral of the difference between the detected and desired power output of the turbine-generator with the desired power output, means responsive to the fourth representation to generate a fifth representation of a desired power output of the high pressure turbine and a sixth representation of a desired power output of the lower pressure turbine, means to detect the power output of the high pressure turbine and generate a seventh representation of the detected power output, means to detect the power output of the lower pressure turbine and generate an eighth representation of the detected power output, means to position the first valve means in accordance with a difference between the fifth representation and the seventh representation to reduce the difference, and means to position the second valve means in accordance with a difference between the sixth representation and the eighth representation to reduce the difference.

58. A power plant according to claim 57 wherein the first and second steam flows are equal when such flows are less than or equal to the desired minimum flow, and the second valve means is fully open when such flows are equal to the desired minimum flow.

59. A power plant according to claim 55 wherein the means to position the first bypass valve means comprise, means to generate a representation of a desired steam pressure at the outlet of the first steam passage portion that corresponds to a desired minimum flow through the first steam passage portion, means to detect the steam pressure at the outlet of the first steam passage portion and generate a representation of the detected steam pressure, and means to position the first bypass valve means in accordance with a difference between the representations of the detected and desired steam pressure at the outlet of the first steam passage portion to reduce the difference, and wherein the means to position the second bypass valve means comprise, means to generate a representation of a desired steam pressure at the outlet of the second steam passage portion that corresponds to a desired minimum steam flow through the second steam passage portion, means to detect the steam pressure at the outlet of the second steam passage portion and generate a representation of the detected pressure, and means to position the second bypass valve means in accordance with a difference between the representations of the detected and desired steam pressure at the outlet of the second steam passage portion to reduce the difference.

60. A power plant according to claim 55 wherein the first bypass valve means is positioned in inverse relation to the position of the first valve means, whereby a change of the first steam flow is compensated by an equal, but opposite, change of the flow through the first bypass line, and the second bypass valve means is positioned in inverse relation to the position of the second valve means, whereby a change of the second steam flow is compensated by an equal, but opposite, change of the flow through the second bypass line.

* * * * *